US007938532B2

(12) United States Patent
Cook et al.

(10) Patent No.: US 7,938,532 B2
(45) Date of Patent: May 10, 2011

(54) HAND HELD PRINTER WITH VERTICAL MISALIGNMENT CORRECTION

(75) Inventors: Brian Dale Cook, Nicholasville, KY (US); Barry Baxter Stout, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 1119 days.

(21) Appl. No.: 11/675,884

(22) Filed: Feb. 16, 2007

(65) Prior Publication Data

US 2008/0198193 A1 Aug. 21, 2008

(51) Int. Cl.
*B41J 2/01* (2006.01)

(52) U.S. Cl. ..... 347/109; 347/108; 347/2

(58) Field of Classification Search ..... 347/2–4, 347/19, 108–109, 110, 5, 9; 400/29
See application file for complete search history.

(56) References Cited

U.S. PATENT DOCUMENTS

| | | | |
|---|---|---|---|
| 4,675,700 | A | 6/1987 | Nagira et al. |
| 4,758,849 | A | 7/1988 | Piatt et al. |
| 4,915,027 | A | 4/1990 | Ishibashi et al. |
| 4,933,867 | A | 6/1990 | Ishigaki |
| 4,947,262 | A | 8/1990 | Yajima et al. |
| 4,949,391 | A | 8/1990 | Faulkerson et al. |
| 4,999,016 | A | 3/1991 | Suzuki et al. |
| 5,013,895 | A | 5/1991 | Iggulden et al. |
| 5,024,541 | A | 6/1991 | Tsukada et al. |
| 5,028,934 | A | 7/1991 | Kasai et al. |
| 5,052,832 | A | 10/1991 | Akiyama et al. |
| 5,063,451 | A | 11/1991 | Yanagisawa et al. |
| 5,093,675 | A | 3/1992 | Koumura et al. |
| 5,110,226 | A | 5/1992 | Sherman et al. |
| 5,111,216 | A | 5/1992 | Richardson et al. |
| 5,149,980 | A | 9/1992 | Ertel et al. |
| 5,160,943 | A | 11/1992 | Pettigrew et al. |
| 5,184,907 | A | 2/1993 | Hamada et al. |
| 5,186,558 | A | 2/1993 | Sherman et al. |
| 5,188,464 | A | 2/1993 | Aaron |
| 5,236,265 | A | 8/1993 | Saito et al. |
| 5,240,334 | A | 8/1993 | Epstein et al. |
| 5,262,804 | A | 11/1993 | Petigrew et al. |
| 5,267,800 | A | 12/1993 | Petteruti et al. |
| 5,308,173 | A | 5/1994 | Amano et al. |
| 5,311,208 | A | 5/1994 | Burger et al. |
| 5,312,196 | A | 5/1994 | Hock et al. |
| 5,344,248 | A | 9/1994 | Schoon et al. |
| 5,355,146 | A | 10/1994 | Chiu et al. |

(Continued)

FOREIGN PATENT DOCUMENTS

WO WO 2004056576 A1 7/2004

(Continued)

*Primary Examiner* — Lam S Nguyen

(57) ABSTRACT

A method for automatically providing vertical misalignment correction in a hand held printer fixedly mounting a printhead having a plurality of ink jetting nozzles arranged in a column includes defining a fixed quantity subset of the plurality of ink jetting nozzles for printing a print swath; defining a reference line corresponding to a desired printing path; assigning print data to the feed quantity subset of the plurality of ink jetting nozzles for printing the print swath along the desired printing path; determining an amount of vertical deviation of the hand held printer from the reference line as the hand held printer is hand-scanned along the desired printing path; and dynamically shifting a location of the fixed quantity subset within the plurality of ink jetting nozzles to compensate for the amount of vertical deviation as the hand held printer is hand-scanned along the desired printing path.

20 Claims, 9 Drawing Sheets

U.S. PATENT DOCUMENTS 5,446,559 A 8/1995 Birk
5,449,238 A 9/1995 Pham et al.
5,462,375 A 10/1995 Isobe et al.
5,475,403 A 12/1995 Havlovick et al.
5,503,483 A 4/1996 Petteruti et al.
5,520,470 A 5/1996 Willett
5,578,813 A 11/1996 Allen et al.
5,650,820 A 7/1997 Sekine et al.
5,664,139 A 9/1997 Spurlock
5,685,651 A 11/1997 Hayman et al.
5,686,720 A 11/1997 Tullis
5,729,008 A 3/1998 Blalock et al.
5,786,804 A 7/1998 Gordon
5,806,993 A 9/1998 Petterutti et al.
5,816,718 A 10/1998 Poole
5,825,044 A 10/1998 Allen et al.
5,829,893 A 11/1998 Kinoshita et al.
5,842,793 A 12/1998 Katayama et al.
5,848,849 A 12/1998 Kishi et al.
5,850,243 A 12/1998 Kinoshita et al.
5,853,251 A 12/1998 Imai
5,887,992 A 3/1999 Yamanashi
5,892,523 A 4/1999 Tanaka et al.
5,927,827 A 7/1999 Reuter et al.
5,953,497 A 9/1999 Kokubo et al.
5,984,455 A 11/1999 Anderson
5,997,193 A 12/1999 Petterutti et al.
6,004,053 A 12/1999 Petteruti et al.
6,005,681 A 12/1999 Pollard
6,010,257 A 1/2000 Petteruti et al.
6,017,112 A 1/2000 Anderson et al.
6,026,686 A 2/2000 Hattori et al.
6,076,910 A 6/2000 Anderson
6,158,907 A 12/2000 Silverbrook et al.
6,195,475 B1 2/2001 Beausoleil, Jr. et al.
6,203,221 B1 3/2001 Tomasik et al.
6,246,423 B1 6/2001 Suzuki et al.
6,249,360 B1 6/2001 Pollard et al.
6,259,826 B1 7/2001 Pollard et al.
6,270,187 B1 8/2001 Murcia et al.
6,270,271 B1 8/2001 Fujiwara
6,338,555 B1 1/2002 Hirose
6,347,897 B2 2/2002 Huggins et al.
6,357,939 B1 3/2002 Baron
6,373,995 B1 4/2002 Mioore
6,394,674 B2 5/2002 Huggins et al.
6,503,005 B1 1/2003 Cockerill et al.
6,533,476 B2 3/2003 Hamisch, Jr. et al.
6,543,893 B2 * 4/2003 Desormeaux ..... 347/109
6,553,459 B1 4/2003 Silverbrook et al.
6,572,290 B2 6/2003 McCleave et al.
6,604,874 B2 8/2003 Carriere et al.
6,607,316 B1 8/2003 Petteruti et al.
6,609,844 B1 8/2003 Petteruti et al.
6,623,191 B2 9/2003 Huggins et al.
6,626,597 B2 9/2003 Fujiwara
6,641,313 B2 11/2003 Bobry
6,648,528 B2 11/2003 Hardisty et al.
6,652,090 B2 11/2003 Silverbrook
6,769,360 B2 8/2004 Walling
6,846,119 B2 1/2005 Walling
6,991,332 B1 * 1/2006 Fan et al. ..... 347/109
2001/0019349 A1 9/2001 Kawakami
2001/0022914 A1 9/2001 Iura et al.
2001/0024586 A1 9/2001 Day et al.
2002/0033871 A1 3/2002 Kaiser
2002/0090241 A1 7/2002 Fujiwara
2002/0127041 A1 9/2002 Huggins et al.
2002/0154186 A1 10/2002 Matsumoto
2003/0031494 A1 2/2003 Cockerill et al.
2003/0063938 A1 4/2003 Hardisty et al.
2003/0117456 A1 6/2003 Silverbrook et al.
2004/0009024 A1 1/2004 Hardisty et al.
2004/0014468 A1 1/2004 Walling
2004/0018035 A1 1/2004 Petteruti et al.
2005/0018032 A1 1/2005 Walling
2005/0018033 A1 1/2005 Walling
2006/0012660 A1 1/2006 Dagborn
2006/0050131 A1 3/2006 Breton
2006/0061647 A1 3/2006 Breton
2006/0165460 A1 7/2006 Breton

FOREIGN PATENT DOCUMENTS

WO WO 2004056577 A1 8/2004
WO WO 2004088576 A1 10/2004
WO WO 2004103712 A1 12/2004

* cited by examiner

HAND HELD PRINTER WITH VERTICAL MISALIGNMENT CORRECTION

BACKGROUND OF THE INVENTION

1. Field of the Invention

The present invention relates to hand held printers, and, more particularly, to a hand held printer with vertical misalignment correction.

2. Description of the Related Art

A hand held printer, also sometimes referred to as a hand-operated printer, is a printer that mounts a printhead and ink supply, which may be in the form of an ink jet printhead cartridge, wherein the printer itself Is moved relative to the print medium, such as a sheet of paper, to position the printhead relative to the print medium. Thus, unlike a typical desktop printer, the hand held printer does not include a drive mechanism for physically positioning the printhead relative to the print medium, nor does a hand held printer include a media feed system for feeding a sheet of print media.

The hand held printer is typically referred to as a single axis (X-axis) printer. The hand held printer has an optical encoder that is used to provide position data for firing the printhead by sensing the relative motion of the hand held printer relative to the print medium. Thus, such a hand held printer is designed to print a single swath having a height corresponding to the height of the printhead. However, since the vertical spacing between the printhead nozzles of the printhead is relatively small, e.g., 0.04 millimeters, it is difficult for a user to manually maintain the hand held printer along a straight path, and a small shift of the hand held printer in the vertical direction can produce a noticeable detect in the printed image, e.g., in the form of a wavy line of text.

SUMMARY OF THE INVENTION

The present invention provides a hand held printer that corrects for vertical misalignment of the hand held printer relative to the print medium.

The terms "first" and "second" preceding an element name, e.g., first buffer nozzle portion, second buffer nozzle portion, etc., are used for identification purposes to distinguish between similar elements, and are not intended to necessarily imply order, nor are the terms "first" and "second" intended to preclude the inclusion of additional similar elements.

Also, as used herein, the terms "horizontal" and "vertical" corresponds to directions within or parallel to the plane of print medium, such as a sheet of paper, unless otherwise specified.

The invention, in one form thereof, is directed to a method for automatically providing vertical misalignment correction in a hand held printer fixedly mounting a printhead having a plurality of ink jetting nozzles arranged in a column. The method includes defining a fixed quantity subset of the plurality of ink jetting nozzles for printing a print swath; defining a reference line corresponding to a desired printing path; assigning print data to the fixed quantity subset of the plurality of ink jetting nozzles for printing the print swath along the desired printing path; determining an amount of vertical deviation of the hand held printer from the reference line as the hand held printer is hand-scanned along the desired printing path; and dynamically shifting a location of the fixed quantity subset within the plurality of ink jetting nozzles to compensate for the amount of vertical deviation as the hand held printer is hand-scanned along the desired printing path.

The invention, in another form thereof, is directed to a method for automatically providing vertical misalignment correction in a hand held printer fixedly mounting a printhead having a plurality of ink jetting nozzles arranged in a column. The method includes segmenting the plurality of ink jetting nozzles to reserve a first buffer nozzle portion and a second buffer nozzle portion that initially are not used in printing a print swath; defining a fixed quantity subset of the plurality of ink jetting nozzles for printing the print swath; defining a reference line corresponding to a desired printing path; assigning print dam to the fixed quantity subset of the plurality of ink jetting nozzles for printing the print swath along the desired printing path; hand-scanning the hand held printer along the desired printing path; determining an amount of vertical deviation of the hand held printer from the reference line as the hand held printer is hand-scanned along the desired printing path; and dynamically shifting a location of the fixed quantity subset into one of the first buffer nozzle portion and the second buffer nozzle portion to compensate for the amount of vertical deviation as the hand held printer is hand-scanned along the desired printing path.

The invention, in another form thereof, is directed to a method for providing vertical misalignment correction in a hand held printer fixedly mounting a printhead having a plurality of ink jetting nozzles arranged in a column. The method includes defining a reference line corresponding to a desired printing path; and displaying an aiming pattern on the display screen to aid a user in keeping the hand held printer on the reference line corresponding to the desired printing path as the hand held printer is hand-scanned along the desired printing path, so as to reduce an amount of vertical deviation of the hand held printer from the reference line as the hand held printer is hand-scanned along the desired printing path.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Figure 1:
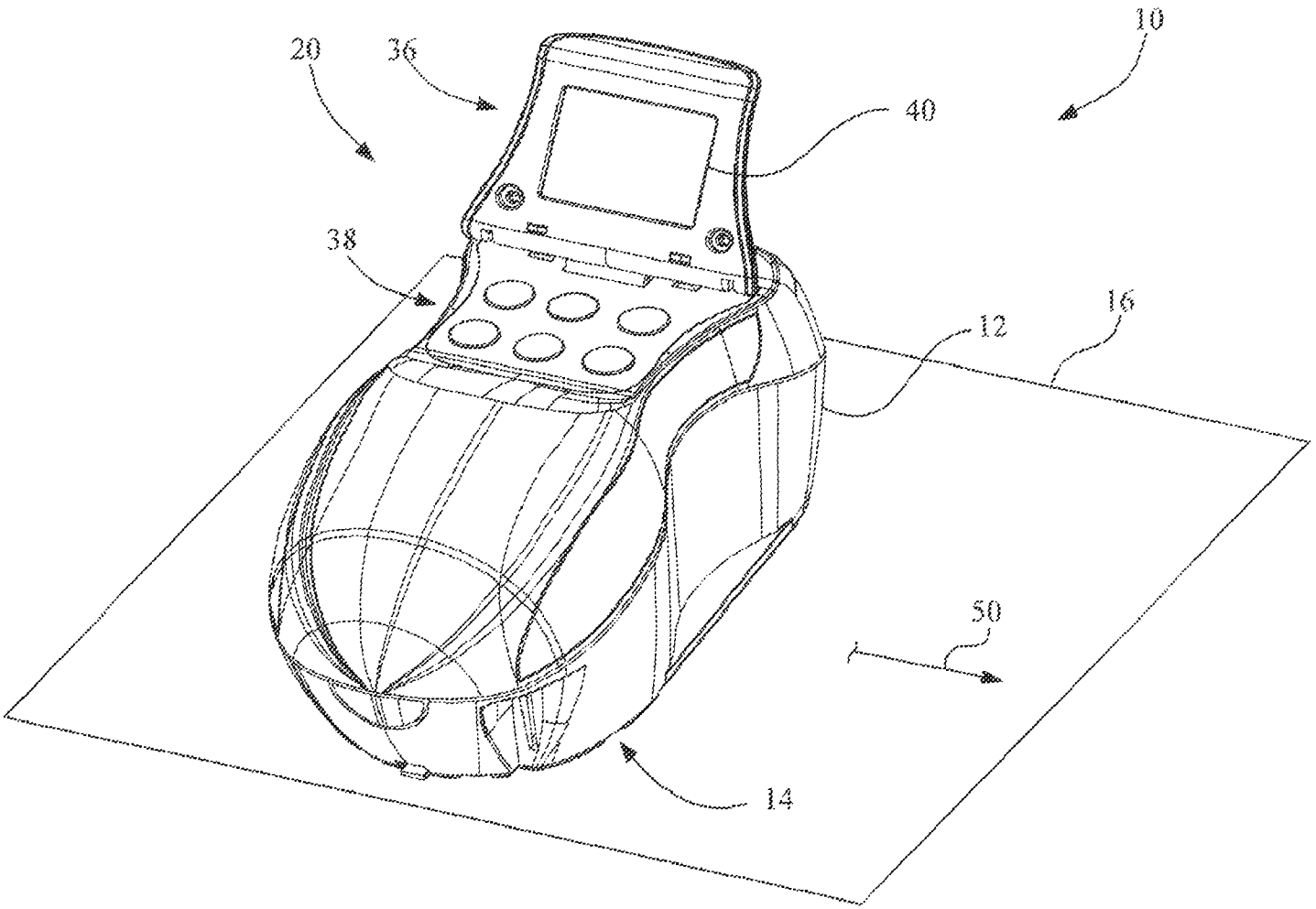
FIG. 1 is a perspective view of a hand held printer in accordance with an embodiment of the present invention.

Referring now to the drawings and particularly to FIG. 1 there is shown a perspective view of a hand held printer 10. Hand held printer 10 includes a body 12. Body 12 is configured with a surface 14, e.g., a smooth surface, that contacts a print medium 16, such as for example, a sheet of paper, transparency, card stock, fabric, hard surface, soft surface, etc. During operation, a user provides the motive force to provide movement of hand held printer 10 relative to print medium 16.

Figure 2:
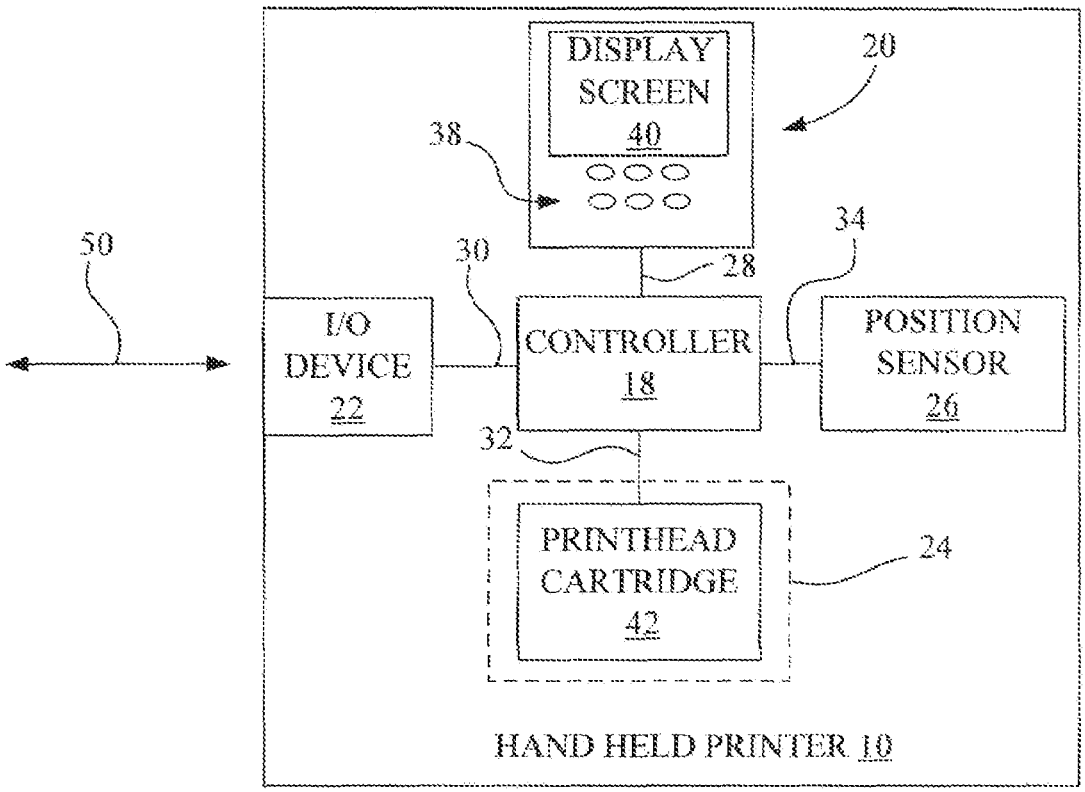
FIG. 2 is a general diagrammatic representation of the hand held printer of FIG. 1.

FIG. 2 is a general diagrammatic representation of hand held printer 10. Hand held printer 10 may be, for example, a hand held ink jet printer, and may include a controller 18, an operator panel 20, an input/output (I/O) device 22, a cartridge receptacle 24, and a position sensor 26. Each of controller 18, operator panel 20. I/O device 22, cartridge receptacle 24, and position sensor 26 is mounted to body 12.

Controller 18 includes a processor unit and associated memory, and may be formed as one or more Application Specific Integrated Circuits (ASIC). Controller 18 executes program instructions to perform daw processing and formatting, facilitate device control, and/or facilitate device interaction with respect to a plurality of devices in communication with controller 18. Controller 18 is communicatively coupled to operator panel 20 via communications link 28. Controller 18 is communicatively coupled to I/O device 22 via communications link 30. Controller 18 is communicatively coupled to cartridge receptacle 24 via a communications link 32. Controller 18 is communicatively coupled to position sensor 26 via a communications link 34. As used herein, the term "communications link" generally refers to structure that facilitates electronic communication between components, and may operate using wired or wireless technology.

As shown in FIGS. 1 and 2, operator panel 20 includes a display device 36, coupled by hinges to body 12, and a plurality of control buttons 38. Display device 36 and control buttons 38 are communicatively coupled to controller 18 via communications link 28. Display device 36 includes a display screen 40, which may be, for example, a liquid crystal display (LCD) having, for example, a resolution (height×width) of 81×101 pixels. Control buttons 38 may include, for example, a POWER button, a PRINT, etc. Of course, the number of buttons and their associated function may depend on the actual configuration of the hand held printer and the applications for which the hand held printer may be used.

I/O device 22 may be configured in a variety of ways, depending on the source and/or destination of the communicated content. For example, I/O device 22 may be a wired or wireless communication device that provides a communications link to a host computer, or some other intelligent device, that may supply image data for printing by hand held printer 10. Alternatively, I/O device 22 may be a local source of image content, such as for example, a memory card reader and associated memory card.

Figure 3:
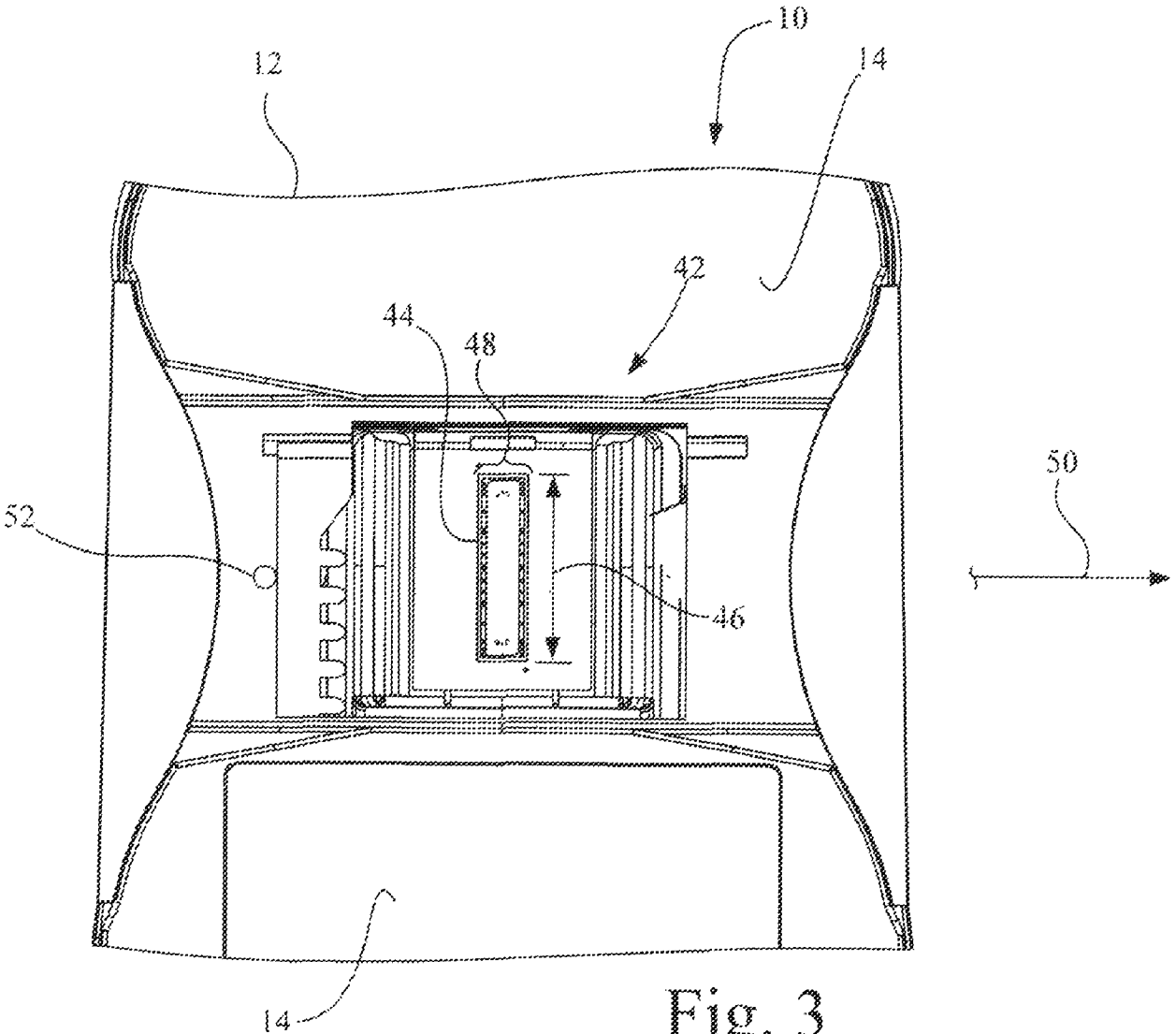
FIG. 3 is an enlarged bottom view of the hand held printer of FIG. 1.

Cartridge receptacle 24, for example, may be formed in body 12 and configured for receiving and mounting at least one printhead cartridge 42. Cartridge receptacle 24 holds printhead cartridge 42 in a fixed position relative to, i.e., is removably yet fixedly mounted to, hand held printer 10. Printhead cartridge 42 is communicatively coupled to controller 18 via communications link 32. As shown in the example of FIG. 3, printhead cartridge 42 includes a printhead 44 and a supply of ink (not shown). Printhead 44 may, for example, have a printhead height 46 of 0.5 inches, and may be formed by a plurality of ink jetting nozzles 48 arranged in one or more columns.

Movement of the hand held printer 10 relative to print medium 16 in a travel direction 50, e.g., a horizontal path, results in relative movement of printhead cartridge 42 and printhead 44 with respect to a printing surface of print medium 16. The smooth surface 14 of body 12 contacts print medium 16 to provide the desired spacing between printhead 44 and the printing surface of print medium 16.

In the present embodiment, position sensor 26 is a two-dimensional sensor that collects two-dimensional position data, which, may also sometimes be referred to herein as X-axis data and Y-axis data. Position sensor 26 may be implemented as a charge-coupled device (CCD) of 255×255 pixels having an associated lens 52 positioned on the underside of hand held printer 10, as shown in FIG. 3. Position sensor 26 sends the collected two-dimensional position data (e.g. X-axis and Y-axis data) to controller 18 via communications link 34. Controller 18 executes program instructions to process the two-dimensional position data generated by position sensor 26.

Figure 4A:
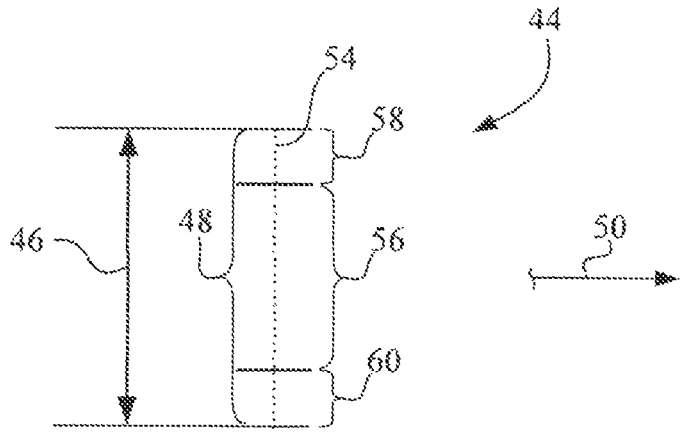
FIG. 4A is a schematic illustration of the printhead of the hand held printer of FIG. 1, wherein the ink jetting nozzles are segmented into a central nozzle portion, an upper buffer nozzle portion, and a lower buffer nozzle portion.
Figure 4B:
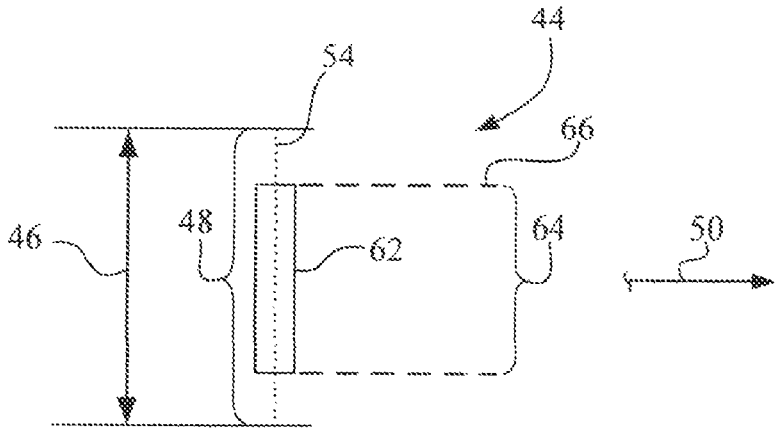
FIG. 4B Is a schematic illustration of the printhead of the hand held printer of FIG. 1, depicting a fixed quantity subset of the plurality of ink jetting nozzles.
Figure 4C:
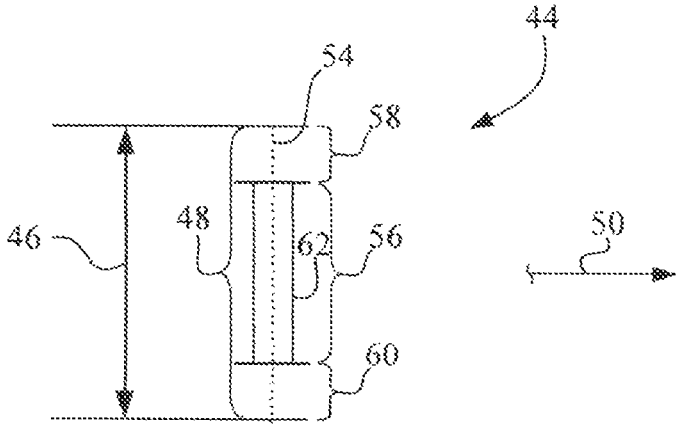
FIG. 4C is a schematic illustration of the printhead of the hand held printer of FIG. 1, depicting a relationship between the fixed quantity subset of the plurality of ink jetting nozzles of FIG. 4B and the central nozzle portion, the upper buffer nozzle portion, and the lower buffer nozzle portion of FIG. 4A.

Referring now to FIGS. 4A-4C, and particularly FIG. 4A, there is shown a schematic illustration of printhead 44 wherein ink jetting nozzles 48 are arranged in an exemplary column 54. The height of column 54 from the uppermost nozzle to the lowermost nozzle defines that printhead height 46. In accordance with an aspect of the present invention, column 54 having the plurality of ink jetting nozzles 48 is segmented into a central nozzle portion 56, an upper buffer nozzle portion 58, and a lower buffer nozzle portion 60. For example, assume that the total number of the plurality of ink jetting nozzles 48 is 300. The printhead height 44 of column 54 of 300 nozzles, assuming a spacing between nozzles is $1/600^{th}$ of an inch, is one-half of an inch and the vertical resolution of printhead 44 is 600 dpi (dots per inch). Also, in this example, assume that central nozzle portion 56 is defined to include 262 nozzles of the plurality of ink jetting nozzles 48. Thus, in this example, thirty-eight nozzles are left over to serve as buffer nozzles, which may be divided into nineteen nozzles for upper buffer nozzle portion 58 and nineteen nozzles for lower buffer nozzle portion 60. The defined number of nozzles in central nozzle portion 56 may be determined by first defining the number of buffer nozzles in the sum of upper buffer nozzle portion 58 and lower buffer nozzle portion 60, with the reminder being designated for central nozzle portion 56.

As an initial consideration, the print pattern, e.g., print swath height, is shrunk to fit the number of available nozzles in central nozzle portion 56 so that the print pattern does not initially extend into upper nozzle portion 58 or lower nozzle portion 60. Therefore, the optimal number of buffer nozzles may come from usability studies where the size of the print swath height is maximized while handling a majority of vertical alignment errors. In the example having thirty-eight buffer nozzles, leaving 262 nozzles to print the print swath, a shrinkage of the original full pattern (all 300 nozzles) is of only 13 percent. For a fixed number of buffer nozzles, the print patterns may be rescaled and pre-formatted to reflect the number of available nozzles.

Besides setting the amount of buffer nozzles based on usability, the number of buffer nozzles may also either he set by the user or calculated from a specific user's tracking ability. In the first case, there might be a default number of buffer nozzles that can be changed through user preferences. The print pattern would shrink or expand depending on the number of available nozzles. Likewise, controller 18 may monitor the vertical misdirection of hand held printer 10 by the user and reduce the number of buffered nozzles for a next print swath based on better performance by the user.

Figure 5:
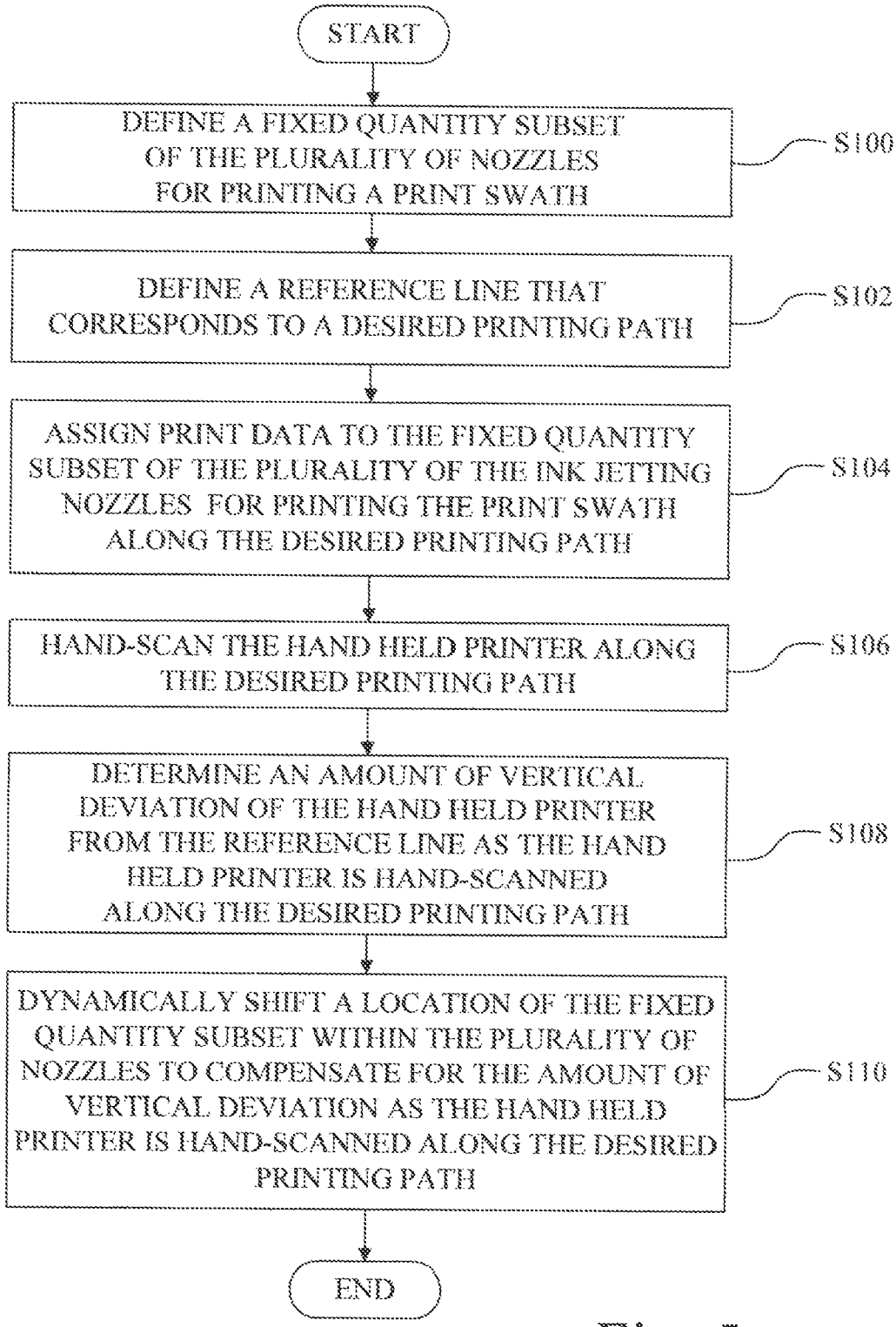
FIG. 5 is a flowchart of a method for automatically providing vertical misalignment correction in a hand held printer, according to an embodiment of the present invention.

FIG. 5 is a flowchart of a method for automatically providing vertical misalignment correction in a hand held printer, such as hand held printer 10, which fixedly mounts printhead 44 having the plurality of ink jetting nozzles 48 arranged in column 54. The method may be implemented by controller 18 of hand held printer 10 by executing program instructions corresponding to the various method steps.

At step S100, a fixed quantity subset of the plurality of nozzles is defined for printing a print swath.

Referring to FIGS. 4A-4C, and particularly FIG. 4B, in accordance with an aspect of the present invention, a fixed quantity subset 62 of the plurality of ink jetting nozzles 48 is defined. The fixed quantity subset 62 represents the adjacent group of nozzles that are available for printing. Although the particular nozzles populating the fixed quantity subset 62 may be changed to provide vertical misalignment correction, as described in more detail below, the quantity of nozzles in the fixed quantity subset 62 does not change.

The fixed quantity subset 62 defines a print swath height, i.e., image height, 64, and the region traced by the fixed quantity subset 62 is a print swath, e.g., print swath 66. Continuing the example from above, the fixed quantity subset 62 of the plurality of ink jetting nozzles 48 will contain less than 300 nozzles, such as for example, 262 nozzles. Thus, in this example, as illustrated in FIG. 4C, initially the fixed quantity subset 62 of the plurality of ink jetting nozzles 48 will correspond to the central nozzle portion 56 of FIG. 4A.

At step S102, a reference line is defined that corresponds to a desired printing path.

Figure 6:
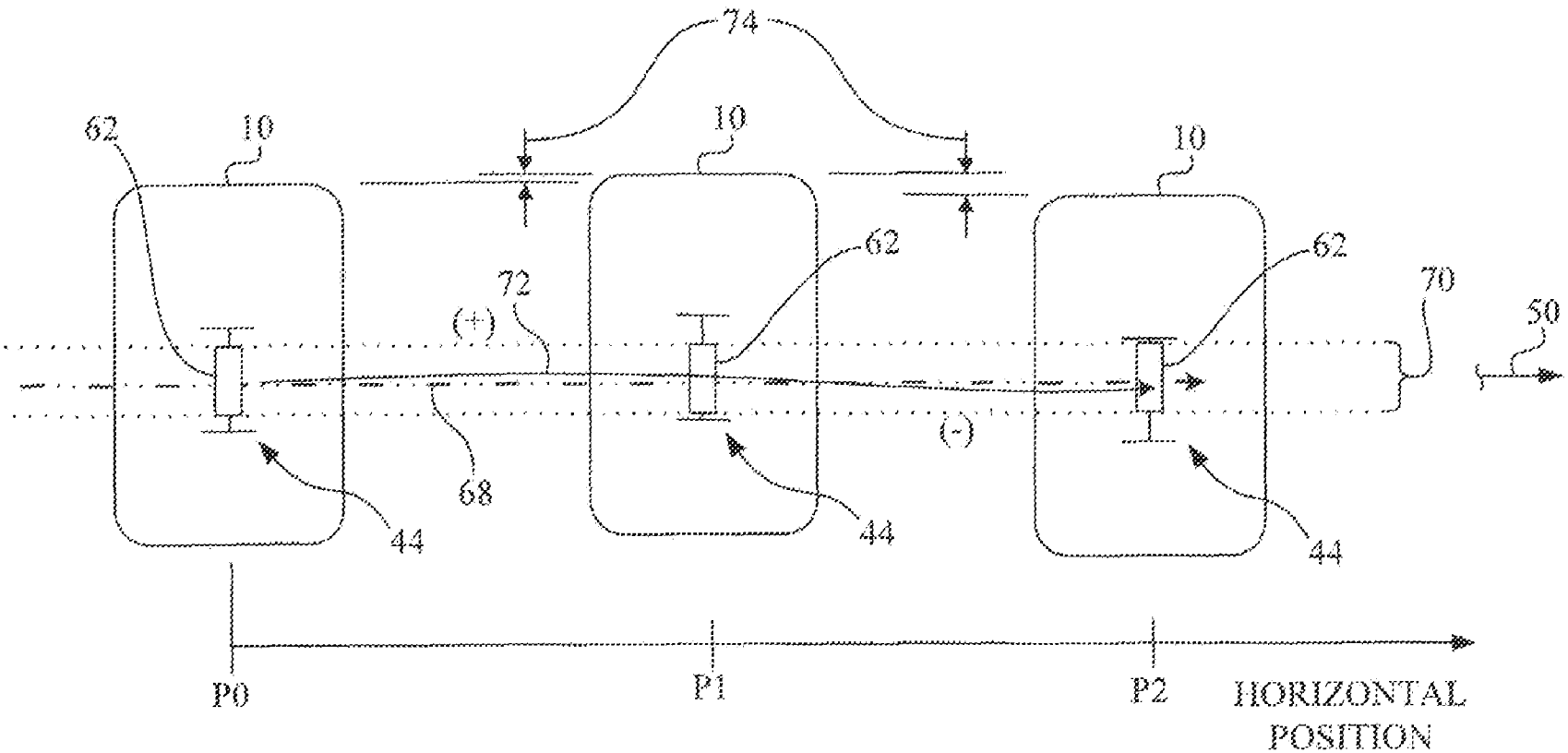
FIG. 6 is a diagrammatic representation of the vertical deviation of the hand held printer of FIG. 1 at various horizontal positions along a desired printing path.

Referring to FIG. 6, a reference fine 68 is defined that corresponds to a desired printing path 70 represented by a pair of parallel dotted lines. In this example, reference line 68 may be located in the center of, and extending parallel to, the desired printing path 70. Reference line 68 need not be a visible line, and may be an imaginary line. Reference line 68 may be oriented, for example, perpendicular to column 54 of the plurality of ink jetting nozzles 48 of printhead 44, and located to horizontally intersects vertical center of the plurality of ink jetting nozzles 48.

In orientating reference line 68, it may be assumed that hand held printer 10 is oriented correctly at the onset of initializing printing, e.g., pressing the PRINT button. As an alternative, a reference trajectory based on some finite small distance from the print start position may be used. A further implementation may be to create a reference pattern based on a running average of the direction of travel. Still another alternative may he for the user to dictate the orientation of reference line 68, e.g., as a horizontal reference line, through an initial movement of hand held printer 10.

At step S104, print data, which may be received via I/O device 22, is assigned to the fixed quantity subset 62 of the plurality of ink jetting nozzles 48 for printing the print swath 66 along the desired printing path 70.

At step S106, hand held printer 10 is moved along the desired printing path 70. However, it may be difficult for a user to manually keep printhead 44 in the proper vertical orientation with respect to reference line 68, and in turn the desired printing path 70.

In FIG. 6, three exemplary static horizontal positions, P0, P1 and P2, of printhead 44 are shown during the printing of print swath 66 along the desired printing path 70. Horizontal position P0 signifies a start print position for hand held printer 10. Horizontal positions P1 and P2 are arbitrary horizontal positions of hand held printer 10 and printhead 44 during a scanning of hand held printer 10 and printhead 44 along an actual printhead path 72 represented by a wavy line. As shown in FIG. 6, there is a variable vertical deviation 74 between the actual printhead path 72 to the desired printing path 70 that represents the vertical misalignment to be corrected. Thus, without the vertical misalignment correction of the present invention, the actual printing would follow the actual printhead path 72 rather than being printed on the desired printing path 70.

At step S108, an amount of vertical deviation 74 of the hand held printer 10 from the reference line 68 is determined as the hand held printer is hand-scanned along the desired printing path 70. The amount of vertical deviation 74 is determined from the Y-axis data supplied to controller 18 from position sensor 26. Sampling of the Y-axis data may occur, for example, at a predefined frequency, e.g., one kilohertz, and may he triggered by horizontal travel in travel direction 50 of a predetermined distance, e.g., 0.5 millimeters.

At step S110, a location of the fixed quantity subset 62 within the plurality of nozzles 48 is dynamically shifted to compensate for the amount of vertical deviation 74 as the hand held printer 10 is hand-scanned along the desired printing path 70. In particular, the fixed quantity subset 62 of said plurality of ink jetting nozzles 48 is shifted from being located entirely in central nozzle portion 56 into one of upper buffer nozzle portion 58 or lower buffer nozzle portion 60 based the vertical direction of vertical deviation 74 of hand held printer 10 from reference line 68.

For example, consider that the region above the reference line 68 is positive (+) and a region below the reference line 68 is negative (−). A positive (+) vertical deviation 74 results in a vertical shift of the fixed quantity subset 62 of the plurality of ink jetting nozzles 48 into lower buffer nozzle portion 60 by an amount of the magnitude of vertical deviation 74, so as to keep print swath 66 being printed by hand held printer 10 horizontally aligned with respect to reference line 68, and in turn, so as to maintain print swath 66 on the desired printing path 70.

Likewise, a negative (−) vertical deviation 74 results in a vertical shift of the fixed quantity subset 62 of the plurality of ink jetting nozzles 48 into upper buffer nozzle portion 58 by an amount of the magnitude of vertical deviation 74, so as to keep print swath 66 being printed by hand held printer 10 horizontally aligned with respect to reference line 68, and in turn, so as to maintain print swath 66 on the desired printing path 70.

Hand held printer 10 has functionality to individually address nozzle firing of each of the plurality of ink jetting nozzles 48, which facilitates controller 18 in being able to shift the fixed quantity subset 62, i.e., the firing nozzles, of the plurality of ink jetting nozzles 48 in real time. Alternatively, the shifting may be effected, for example, by shifting the firing nozzles in the formatter function of controller 18. As another alternative, an external multiplexer component under the control of controller 18 may act as external switcher and shift the fixed quantity subset 62, i.e., the firing nozzles, of the plurality of ink jetting nozzles 48.

There may be eases where the amount of magnitude of vertical deviation 74 becomes greater than the height of upper buffer nozzle portion 58 or the height of lower buffer nozzle portion 60. In this event, one possibility is just to continue printing even though vertical misalignment correction can no longer be achieved. Another possibility is to truncate the image data being printed, so the nozzles continue to shift, but not all the image gets printed. In the case of multi-swath printing, for example, controller 18 of hand held printer 10 may attempt try to quickly load slices of data from a different horizontal row of pixels, and in the extreme case, vertical misalignment correction loads the data for the next horizontal print swath. In other words, the swath of data tries to catch up with the printer's vertical registration, since shifting firing nozzles will no longer work.

Figure 7:
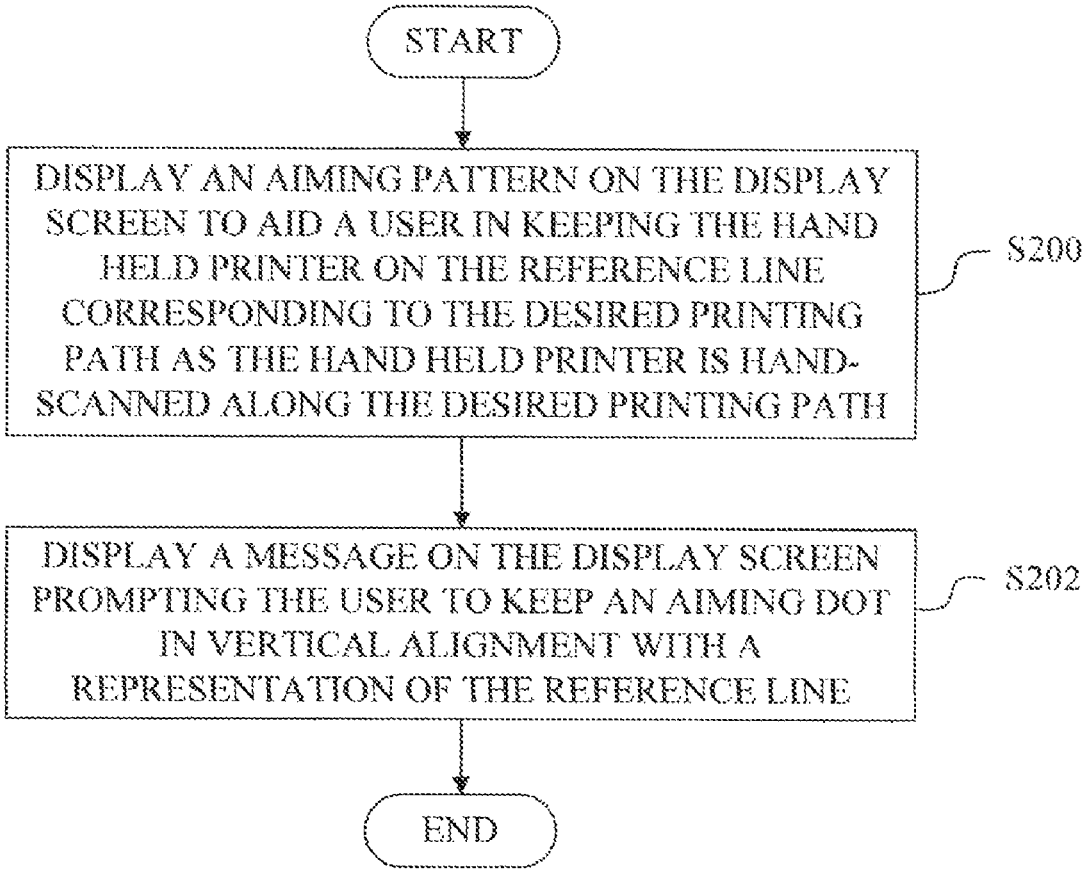
FIG. 7 is a flowchart of a method for monitoring the movement of the hand held printer of FIG. 1 with respect to the desired printing path.
Figure 8:
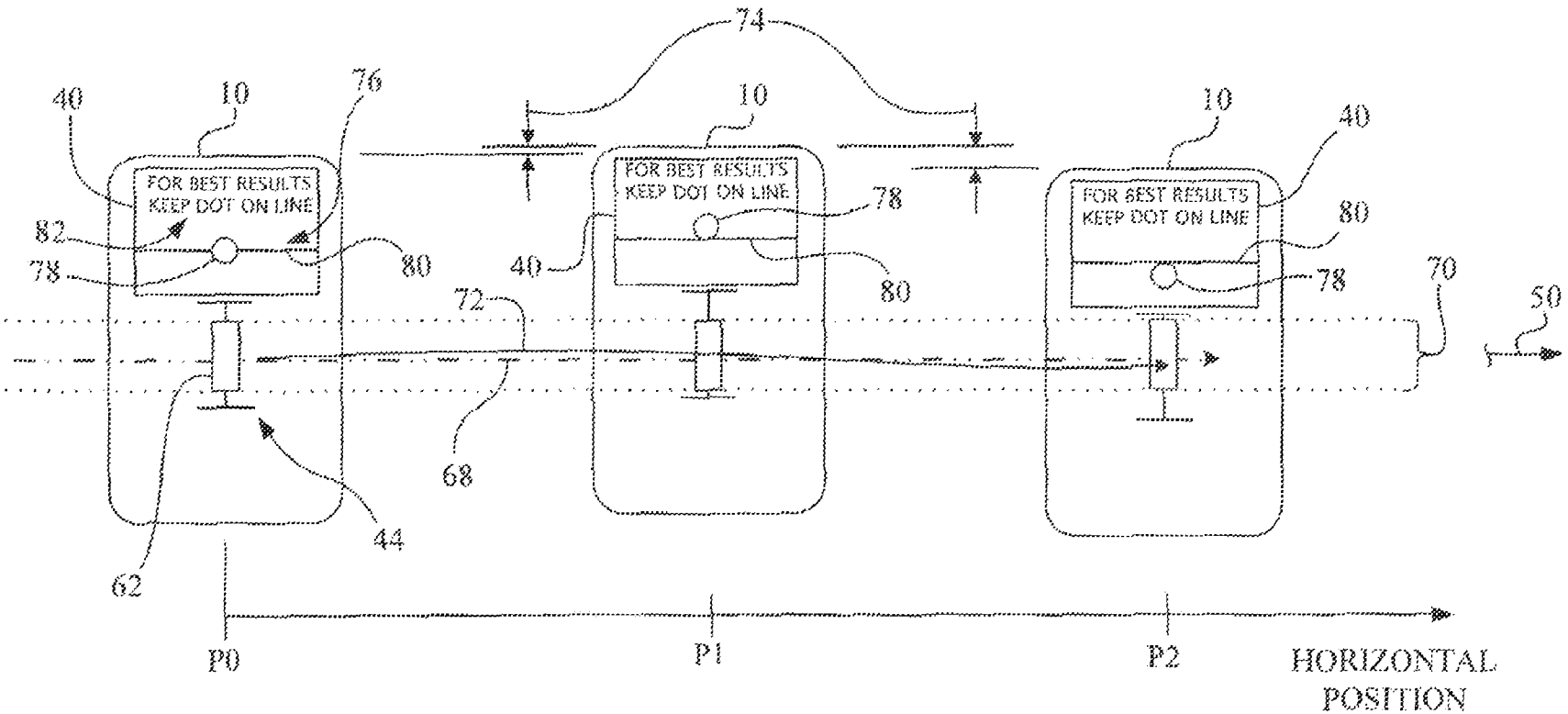
FIG. 8 is a diagrammatic representation of the contents of a display screen of the hand held printer of FIG. 1 during the execution of the method of FIG. 7.
Figure 9:
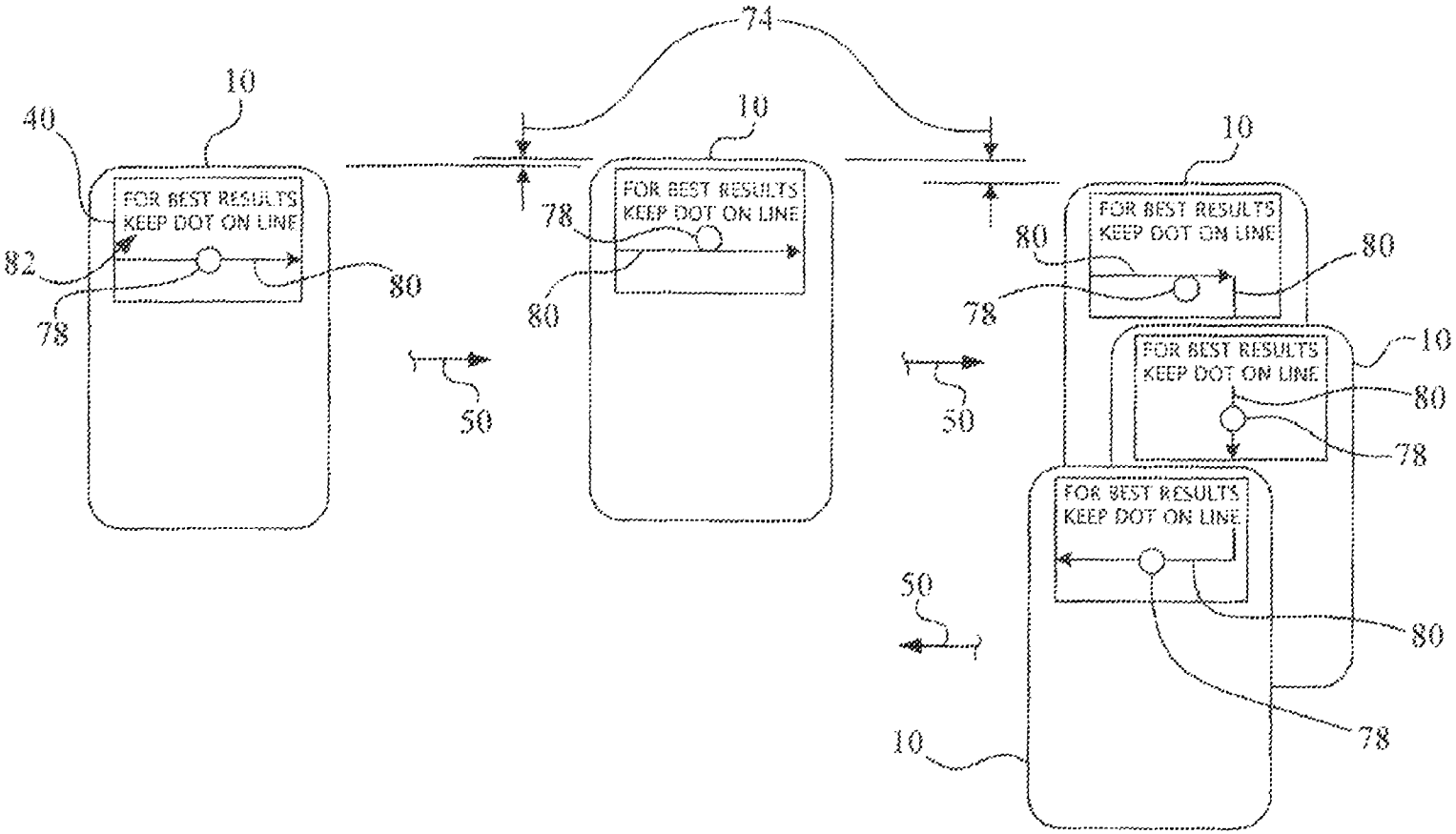
FIG. 9 is a diagrammatic representation of the contents of the display screen of the hand held printer of FIG. 1 dining the execution of the method of FIG. 7 during multi-swath printing.

Supplemental to the method described above, as shown in the flowchart of FIG. 7 in conjunction with the illustrations of FIGS. 8 and 9, the method may further include steps to monitor the movement of hand held printer 10 with respect to the desired printing path 70 and to guide the user in scanning hand held printer with respect to reference line 68.

At step S200, an aiming pattern 76 is displayed on display screen 40 to aid a user in keeping hand held printer 10 on reference line 68 corresponding to the desired printing path 70 as hand held printer 10 is hand-scanned along desired printing path 70. Aiming pattern 76 may include, for example, an aiming dot 78 and a representation 80 of reference line 68.

At step S202, a message 82 is displayed on display screen 40 prompting the user to keep the aiming dot 78 in vertical alignment with representation 80 of reference line 68. In the present example, message 82 reads, "FOR BEST RESULTS KEEP DOT ON LINE".

Aiming dot 78 slides up and down on display screen 40 showing to the user the proper vertical direction of hand held printer 10. Accordingly, the user has some idea how straight hand held printer 10 is moving across the print medium 16. Even though the concept is to correct for vertical misalignment, there is a point that hand held printer 10 runs out of buffered nozzles, e.g., upper buffer nozzle portion 58 or lower buffer nozzle portion 60, and the printed image prints crocked, unless that is the desired effect. The method of FIG. 7 provides user feedback, so the user can see the vertical deviation 74, i.e., vertical misalignment, before it grows too big to be compensated for by the method of FIG. 5. If desired, when the user is about to reach the limit, a warning may he presented by hand held printer 10 to warn the user. The warning may be, for example, a flash of light or message on display screen 40, or a beep.

The method of FIG. 7 may also be used in multi-swath printing, as illustrated in FIG. 9. Considering that body 12 of hand held printer 10 covers from view the surrounding area around printhead 44, it may be difficult to predict where to line up hand held printer 10 for the next print swath. As shown in FIG. 9, the same aiming pattern 76 may be used to guide the user in a vertical direction to a next print swath to print consecutive print swaths. In other words, the aiming dot 78 indicates to the user how much to travel vertically down the page in the margins to line up for the next print swath.

While this invention has been described with respect to embodiments of the invention, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method for automatically providing vertical misalignment correction in a hand held printer fixedly mounting a printhead having a plurality of ink jetting nozzles arranged in a column, comprising:

defining a fixed quantity subset of said plurality of ink jetting nozzles for printing a print swath;

defining a reference line corresponding to a desired printing path;

assigning print data to said fixed quantity subset of said plurality of ink jetting nozzles for printing said print swath along said desired printing path;

determining an amount of vertical deviation of said hand held printer from said reference line as said hand held printer is hand-scanned along said desired printing path; and shifting a location of said fixed quantity subset within said plurality of ink jetting nozzles to compensate for said amount of vertical deviation as said hand held printer is hand-scanned along said desired printing path.

2. The method of claim 1, comprising segmenting said plurality of ink jetting nozzles into a central nozzle portion, an upper buffer nozzle portion, and a lower buffer nozzle portion, wherein initially said fixed quantity subset of said plurality of ink jetting nozzles corresponds to said central nozzle portion.

3. The method of claim 2, wherein said fixed quantity subset of said plurality of ink jetting nozzles is shifted vertically into one of said upper buffer nozzle portion and lower buffer nozzle portion based on a vertical direction of said vertical deviation of said hand held printer from said reference line.

4. The method of claim 3, wherein a region above the reference line is considered positive and a region below the reference line is considered negative, and wherein a positive vertical deviation results in a vertical shift of said fixed quantity subset of said plurality of ink jetting nozzles into said lower buffer nozzle portion to keep said print swath horizontally aligned with respect to said reference line so as to maintain said print swath on said desired printing path.

5. The method of claim 3, wherein a region above the reference line is considered positive and a region below the reference line is considered negative, and wherein a negative vertical deviation results in a vertical shift of said fixed quantity subset of said plurality of ink jetting nozzles into said upper buffer nozzle portion to keep said print swath horizontally aligned with respect to said reference line so as to maintain said print swath on said desired printing path.

6. The method of claim 1, wherein said reference line is oriented perpendicular to said column of said plurality of ink jetting nozzles of said printhead, and intersects a center of said plurality of ink jetting nozzles.

7. The method of claim 1, wherein said reference line is an imaginary line.

8. The method of claim 1, wherein a depiction of said reference line is displayed on a display screen of said hand held printer.

9. The method of claim 8, wherein an aiming pattern is displayed on said display screen to aid a user in keeping said hand held printer on said reference line corresponding to said desired printing path as said hand held printer is hand-scanned along said desired printing path.

10. The method of claim 9, wherein said aiming pattern includes an aiming dot and a representation of said reference line, the method further comprising displaying a message on said display screen prompting the user to keep said aiming dot in vertical alignment with said representation of said reference line.

11. The method of claim 10, wherein said message on said display screen prompts the user to keep said aiming dot on said representation of said reference line.

12. A method for automatically providing vertical misalignment correction in a hand held printer fixedly mounting a printhead having a plurality of ink jetting nozzles arranged in a column, comprising:

segmenting said plurality of ink jetting nozzles to reserve a first buffer nozzle portion and a second buffer nozzle portion that initially are not used in printing a print swath;

defining a fixed quantity subset of said plurality of ink jetting nozzles for printing said print swath;

defining a reference line corresponding to a desired printing path;

assigning print data to said fixed quantity subset of said plurality of ink jetting nozzles for printing said print swath along said desired printing path;

hand-scanning said hand held printer along said desired printing path;

determining an amount of vertical deviation of said hand held printer from said reference line as said hand held printer is hand-scanned along said desired printing path; and dynamically shifting a location of said fixed quantity subset into one of said first buffer nozzle portion and said second buffer nozzle portion to compensate for said amount of vertical deviation as said hand held printer is hand-scanned along said desired printing path.

13. The method of claim 12, wherein said segmenting divides said plurality of ink jetting nozzles into a central nozzle portion, an upper buffer nozzle portion, and a lower buffer nozzle portion, wherein initially said fixed quantity subset of said plurality of ink jetting nozzles corresponds to said central nozzle portion.

14. The method of claim 13, wherein said fixed quantity subset of said plurality of ink jetting nozzles is shifted vertically into one of said upper buffer nozzle portion and lower buffer nozzle portion based on a vertical direction of said vertical deviation of said hand held printer from said reference line.

15. The method of claim 12, wherein a depiction of said reference line is displayed on a display screen of said hand held printer.

16. The method of claim 15, wherein an aiming pattern is displayed on said display screen to aid a user in keeping said hand held printer on said reference line corresponding to said desired printing path as said hand held printer is hand-scanned along said desired printing path.

17. A method for providing vertical misalignment correction in a hand held printer fixedly mounting a printhead having a plurality of ink jetting nozzles arranged in a column, comprising:

defining a reference line corresponding to a desired printing path; and displaying an aiming pattern on a display screen of the hand held printer to aid a user in keeping said hand held printer on said reference line corresponding to said desired printing path as said hand held printer is hand-scanned along said desired printing path, so as to reduce an amount of vertical deviation of said hand held printer from said reference line as said hand held printer is hand-scanned along said desired printing path.

18. The method of claim 17, wherein said aiming pattern includes an aiming dot and a representation of said reference line, said method including displaying a message on said display screen prompting a user to keep said aiming dot in alignment with said representation of said reference line.

19. The method of claim 18, wherein said representation of said reference line and said aiming dot is used in multi-swath printing to guide a user in a vertical direction to a next print swath to print consecutive print swaths.

20. The method of claim 17, further comprising:

defining a fixed quantity subset of said plurality of ink jetting nozzles for printing a print swath;

assigning print data to said fixed quantity subset of said plurality of ink jetting nozzles for printing said print swath along said desired printing path;

determining an amount of said vertical deviation of said hand held printer from said reference line as said hand held printer is hand-scanned along said desired printing path; and dynamically shifting a location of said fixed quantity subset within said plurality of ink jetting nozzles to compensate for said amount of vertical deviation as said hand held printer is hand-scanned along said desired printing path.

* * * * *